US006318643B1

(12) United States Patent
Cooke

(10) Patent No.: US 6,318,643 B1
(45) Date of Patent: Nov. 20, 2001

(54) FUEL INJECTOR NOZZLE

(75) Inventor: Michael Peter Cooke, Gillingham (GB)

(73) Assignee: Lucas Industries, plc (GB)

( * ) Notice: Subject to any disclaimer, the term of this patent is extended or adjusted under 35 U.S.C. 154(b) by 0 days.

(21) Appl. No.: 09/204,611

(22) Filed: Dec. 2, 1998

(30) Foreign Application Priority Data

Jun. 12, 1997 (GB) ..... 9725805

(51) Int. Cl.[7] ..... B67D 5/08

(52) U.S. Cl. ..... 239/71; 239/533.2; 239/584; 239/600

(58) Field of Search ..... 239/600, 71, 584, 239/533.2; 285/382, 333, 334, 355, 390; 277/609, 608, 617, 625

(56) References Cited

U.S. PATENT DOCUMENTS

| | | | | |
|---|---|---|---|---|
| 2,812,977 | * | 11/1957 | Phillips | 239/600 |
| 2,829,709 | * | 4/1958 | Mathews | 239/600 |
| 3,096,023 | * | 7/1963 | Thomas | 239/600 |
| 3,273,805 | * | 9/1966 | Hall | 239/600 |
| 3,343,798 | * | 9/1967 | Senft | 239/71 |
| 3,558,062 | * | 1/1971 | See | 239/600 |
| 3,608,171 | | 9/1971 | Stradtmann . | |
| 3,756,516 | * | 9/1973 | Trnka | 239/600 |
| 4,749,131 | * | 6/1988 | Katchka | 239/600 |
| 4,778,107 | | 10/1988 | Kojima et al. . | |
| 4,938,193 | | 7/1990 | Raufeisen et al. . | |
| 5,307,991 | * | 5/1994 | Hanson et al. | 239/600 |
| 5,337,958 | * | 8/1994 | Hennessy et al. | 239/71 |
| 5,380,118 | * | 1/1995 | Stahlecker et al. | 403/343 |
| 5,964,297 | * | 10/1999 | Edman | 185/382 |

FOREIGN PATENT DOCUMENTS 0 242 978 10/1987 (WO) .

* cited by examiner

*Primary Examiner*—Kevin Shaver
*Assistant Examiner*—Christopher S Kim
(74) *Attorney, Agent, or Firm*—Andrus, Sceales, Starke & Sawall

(57) ABSTRACT

A nozzle for a fuel injector comprises a nozzle holder, a tip secured to the nozzle holder, the tip being provided with at least one outlet opening, and a feature provided on the tip providing an indication of the position(s) of the opening(s).

3 Claims, 3 Drawing Sheets

FUEL INJECTOR NOZZLE

This invention relates to a nozzle for a fuel injector intended for use in delivering fuel, under pressure, to a cylinder of a compression ignition engine.

Fuel injector nozzles generally comprise a nozzle body provided with an axially extending blind bore within which a valve needle is slidable, in use. A frustoconical seating is generally provided adjacent the blind end of the bore, the needle being engageable with the seating to control the supply of fuel past the seating to one or more outlet openings.

Where the injector is of relative great length and small diameter, it is difficult and inconvenient to machine the seating, and it is known to provide nozzles of two-part form which comprise a nozzle tip within which the seating is machined and an elongate nozzle holder to which the nozzle tip is secured.

As the nozzle tip is a separate component, the orientation of the outlet openings provided in the nozzle tip relative to the nozzle holder cannot be assured. The axial position of the seating relative to the remainder of the injector may also vary. It is an object of the invention to provide a nozzle and a method of manufacturing a nozzle in which these disadvantages are overcome.

According to the invention there is provided a nozzle comprising a nozzle holder, and a nozzle tip, the nozzle tip being provided with at least one outlet opening and a feature provided on the nozzle tip providing an indication of the position(s) of the opening(s).

The invention also relates to a method of manufacturing a nozzle of the type defined hereinbefore including the step of aligning the feature with part of the nozzle holder.

Clearly, such an arrangement has the advantage that the outlet openings can be correctly and reliably positioned relative to the nozzle holder. Further, a gasket or captured seal can be trapped between the tip and the nozzle holder.

According to another aspect of the invention there is provided a method of manufacturing a nozzle comprising securing a nozzle tip to a nozzle holder and subsequently machining at least one outlet opening in the nozzle tip.

The invention will further be described, by way of example, with reference to the accompanying drawings, in which.

Figure 2:
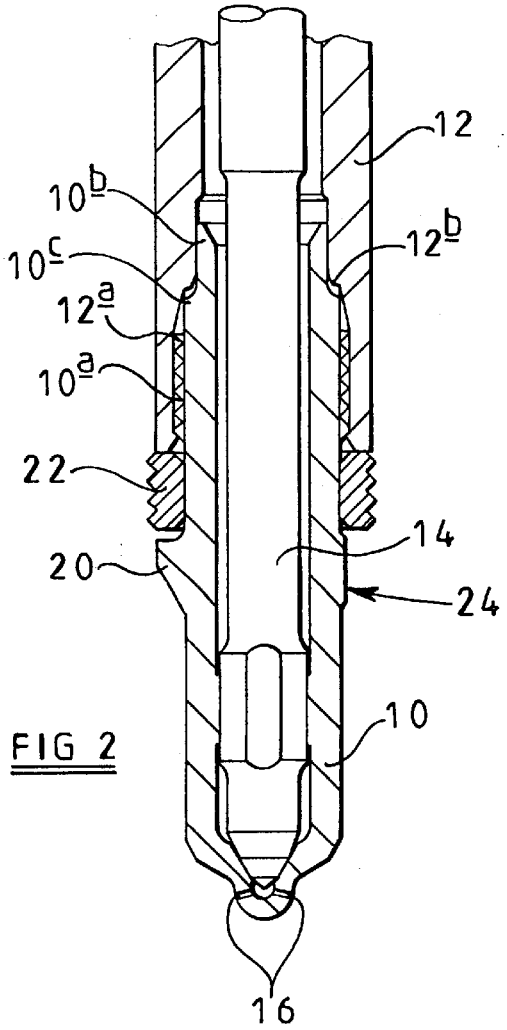
FIG. 2 is an enlargement of part of FIG. 1.
Figure 2A:
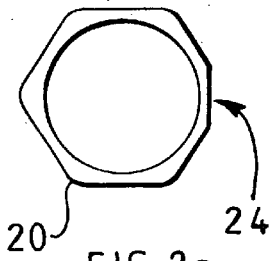
Figure 3:
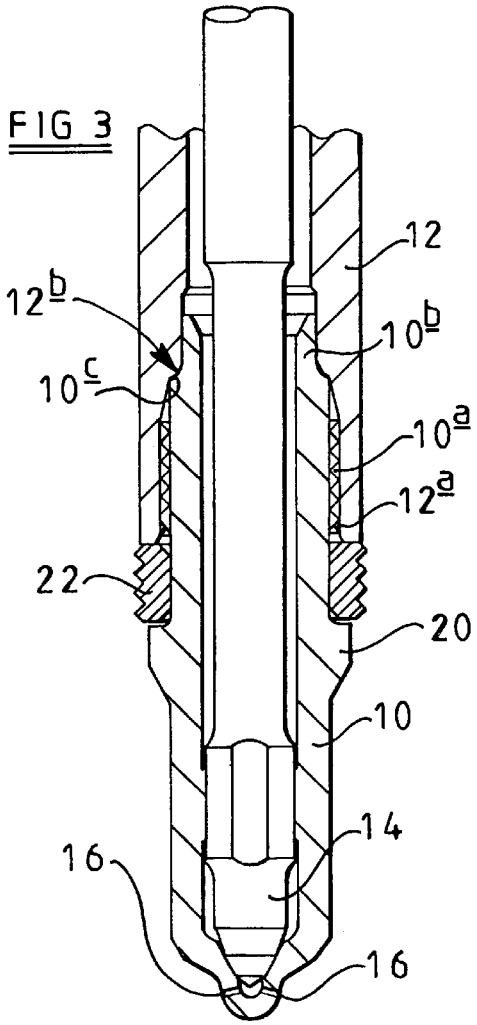
Figure 3A:
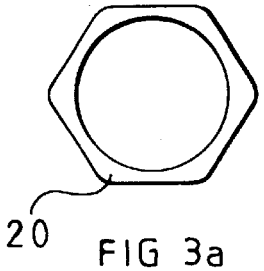
Figure 4:
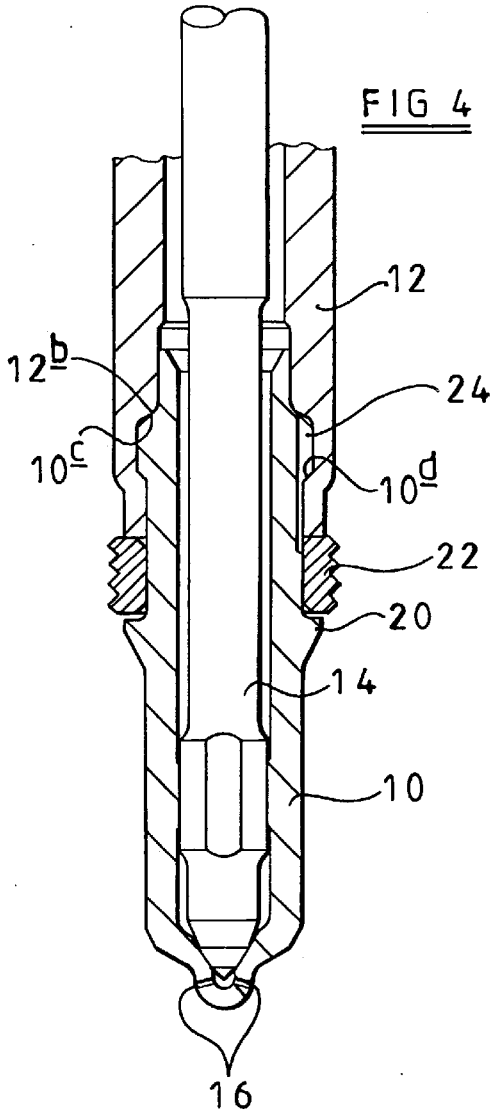
Figure 5:
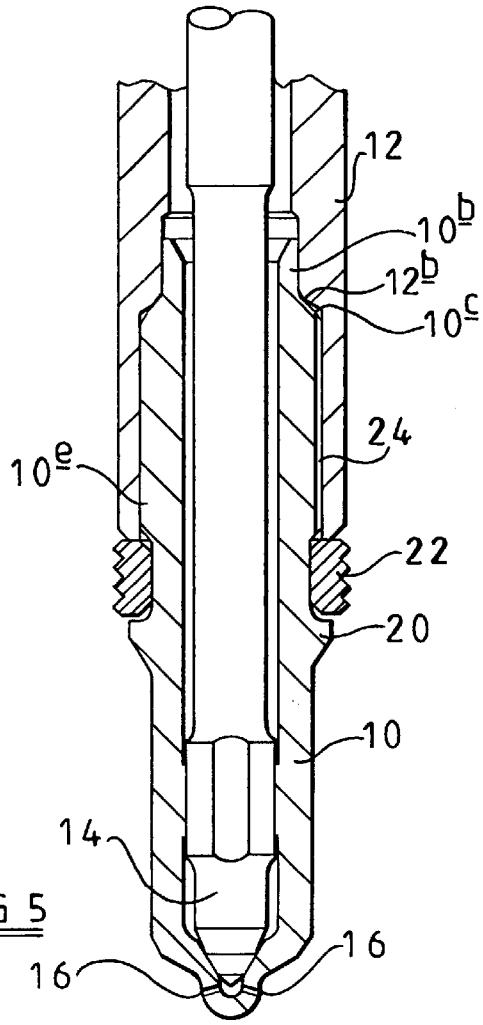

FIG. 2*a* is a diagrammatic sectional view through the embodiment shown in FIG. 2; and FIGS. 3 to 5 are views similar to FIG. 2 of alternative arrangements.

Figure 1:
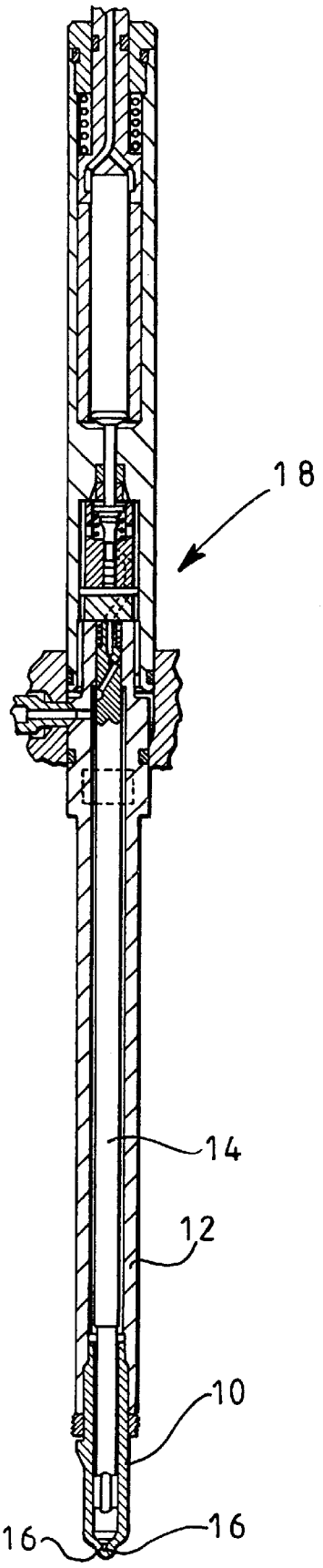
FIG. 1 is a view of an injector incorporating a nozzle in accordance with an embodiment of the invention.

The injector illustrated in FIGS. 1 and 2 comprises a nozzle tip 10 which is secured to a nozzle holder 12, an injector needle 14 being slidable within bores formed in the nozzle holder 12 and tip 10. An end of the needle 14 is engageable with a frustoconical seating formed around a blind end of the bore formed in the tip 10, engagement of the valve needle 14 with the seating controlling the flow of fuel to a plurality of outlet openings 16 provided in the tip 10.

The injector includes an actuator arrangement 18 which controls movement of the needle 14 away from and towards its seating to control injection of fuel through the outlet openings 16.

As illustrated in FIG. 2, the nozzle holder 12 includes, at its lower end, an internally screw-threaded region 12*a* which is arranged to mate with an externally screw-threaded region 10*a* of the tip 10 to secure the tip 10 to the nozzle holder 12.

Upstream of the screw-threaded engagement between the tip 10 and nozzle holder 12, a portion 10*b* of the tip 10 engages the inner surface of the nozzle holder 12 in an interference fit manner to form a substantially fluid tight seal between the nozzle holder 12 and the tip 10. The tip 10 further includes a stepped region defining a shoulder 10*c* which is engageable with a similar shoulder 12*b* of the nozzle holder 12 to limit movement of the tip 10 relative to the nozzle holder 12, thereby ensuring that the seating is located at a predetermined distance from the lower end of the nozzle holder 12.

The tip 10 is provided with flange 20 of part hexagonal form (as illustrated in FIG. 2*a*), and a gasket member 22 is located around the tip 10, the gasket member 22 being trapped between the lower end of the nozzle holder 12 and the flange 20. The gasket 22 is used to form a fluid tight seal between the injector nozzle and an adjacent part of an engine, in use.

As indicated at 24 in FIGS. 2 and 2*a*, a flat is formed in the flange 20, the flat 24 being indicative of the positions of the outlet openings 16. During assembly of the nozzle, the tip 10 is rotated relative to the nozzle holder 12 to secure the tip 10 to the nozzle holder 12, an appropriate tool engaging the flange 20 to rotate the tip 10, rotation continuing until the shoulder 10*c* of the tip 10 engages the shoulder 12*b* of the nozzle holder 12, thus ensuring that the seating is the correct distance beneath the lower end of the nozzle holder 12. Once this position has been achieved, the angular position of the tip 10 relative to the nozzle holder 12 is adjusted to bring the flat 24, and hence the position of the outlet openings 16 to the correct angular position relative to the nozzle holder 12. It will be appreciated that such angular adjustment results in some axial movement of the seating relative to the lower end of the nozzle holder 12, but by using a fine pitch thread to secure the tip 10 to the nozzle holder 12, this axial displacement is minimised.

Rather than rotating the tip 10 until engagement occurs between the shoulders 10*c*, 12*b* to assure the axial position of the seating, the rotation may be stopped once a particular datum position is reached, for example when the overall length of the injector reaches a desired value or the tip 10 protrudes from the holder 12 by a predetermined distance. The adjustment of the angular positioning of the openings 16 is then carried out.

Clearly, in order to produce a fluid tight seal between the tip 10 and nozzle holder 12, it is desirable for the part of the tip 10 which engages the nozzle holder 12 to be of relatively soft, and hence easily deformable material, whereas the seating should be of hard material in order to minimise wear. This can be achieved by, for example, case hardening the tip 10 after plating the part of the tip 10 which is to engage the nozzle holder 12, or alternatively by case hardening the complete tip and then machining away the hardened material from the part of the tip 10 which is to engage the nozzle holder 12. As a further alternative, the tip 10 may be completely case hardened, and an insert of relatively soft material introduced between the tip 10 and nozzle holder 12 prior to securing the tip in position, the soft material insert being deformed upon securing the tip 10 in position to form the fluid tight seal between the tip 10 and nozzle holder 12.

The portion 10*b* of the tip 10 is of relatively thin wall thickness which assists in allowing this part of the tip 10 to yield and deform during assembly, thus reducing the stress which must be applied to the nozzle holder 12 during assembly. Further, as the portion 10*b* is of relatively low wall thickness, the load tending to force the tip 10 out of the nozzle is reduced, and hoop stress in the nozzle holder 12 is reduced.

Although in the description hereinbefore, the feature which provides an indication of the location of the openings 16 is a flat, it will be appreciated that other features, for example a short blind drilling or a groove could be used.

The arrangement illustrated in FIG. 3 differs from that of FIG. 2 in that the flat 24 is omitted from the tip 10, and the openings 16 are not predrilled prior to securing the tip 10 to the nozzle holder 12. The assembly process comprises securing the tip 10 to the nozzle holder 12 using the screw-threaded engagement therebetween, and tightening the tip 10 to the nozzle holder 12 until the shoulder 10*c* of the tip 10 engages the shoulder 12*b* of the nozzle holder 12, such engagement ensuring that the seating is correctly located beneath the lower end of the nozzle holder 12 or until a datum position is reached. Once the tip 10 occupies this position, the tip 10 is machined to provide the outlet openings 16 in the lower end thereof in the correct positions relative to the nozzle holder 12. As mentioned hereinbefore, the upper end of the tip 10 is conveniently relatively soft to permit deformation thereof to create a fluid tight seal between the nozzle holder 12 and the tip 10. Alternatively, an annular member of relatively soft material may be trapped between the tip 10 and nozzle holder 12 to form a substantially fluid tight seal therebetween.

The arrangement illustrated in FIG. 4 differs from the arrangement of FIG. 2 in that no screw-threaded engagement is provided between the tip 10 and nozzle holder 12. Instead, the tip 10 is secured to the nozzle holder 12 by deforming the lower end portion of the nozzle holder 12 after the tip 10 has been inserted to a sufficient extent that a shoulder 10*c* thereof engages the shoulder 12*b* of the nozzle holder 12, thus ensuring that the seating is correctly positioned relative to the lower end of the nozzle holder 12, and after the angular position of the tip 10 relative to the nozzle holder 12 has been adjusted using an axially extending slot, flat region or groove 24 as a reference indicative of the positions of the openings 16 in the lower end of the tip 10. Once the tip 10 is correctly positioned relative to the nozzle holder 12, the lower end of the nozzle holder 12 is deformed to engage a second shoulder 10*d* formed on the insert 10 to secure the tip 10 in position relative to the nozzle holder 12.

The provision of the axially extending slot, flat or groove 24 is further advantageous in that should the high pressure seal between the tip 10 and nozzle holder 12 start to leak, the escaping fuel can pass along the axially extending slot, flat or groove 24, thus avoiding a build up of pressure between the nozzle holder 12 and tip 10.

As described hereinbefore, in order to obtain a fluid tight seal between the tip 10 and nozzle holder 12, the upper end of the tip 10 is conveniently formed of a relatively soft material, or alternatively an insert of relatively soft material may be located between the tip 10 and nozzle holder 12.

The arrangement of FIG. 5 differs from those described hereinbefore in that the tip 10 is secured to the nozzle holder 12 by being an interference fit therein. As described hereinbefore, the upper end portion 10*b* of the tip 10 is an interference fit with a part of the nozzle holder 12 to form a substantially fluid tight seal between the nozzle holder 12 and tip 10. In addition to this interference fit, a further portion 10*e* of the tip 10 is an interference fit with a lower portion of the nozzle holder 12, this interference fit securing the tip 10 to the nozzle holder 12. As in the arrangement illustrated in FIG. 4, an axially extending slot, flat or groove 24 is provided to provide an indication of the positions of the openings 16 during assembly, thus ensuring that the openings 16 are correctly located relative to the nozzle holder 12. The slot, flat or groove 24 again may act to permit fuel to escape from the injector should the high pressure seal fail or start to weep.

It will be recognized that as the interference fit securing the tip 10 to the nozzle holder is not subjected to fuel at injection pressure, it can be of relatively large diameter without risk of the tip being forced out of the nozzle holder 12.

As mentioned hereinbefore, an annular member of relatively soft material may be trapped between the tip 10 and nozzle holder 12 to provide the fluid tight seal therebetween, if desired.

What is claimed is:

1. A fuel injection for use in delivering fuel to a compression ignition engine, comprising an injection nozzle holder and a nozzle tip, the tip being provided with at least one outlet opening having a radially offset position with respect to a longitudinal axis of the tip, and a feature provided on the tip providing an indication of the position of said at least one outlet opening, wherein the tip includes a first region which is a radial interference fit in the nozzle holder to form a substantially fluid-tight seal between the nozzle holder and the first region of the tip, the tip further comprising a second, external screw-threaded region which is secured to an internal screw threaded region of the nozzle holder by a rotational screw-threaded engagement, a first shoulder on the tip separating said first and second regions and engageable with a second shoulder on the nozzle holder, and wherein the first region is arranged upstream with respect to the direction of fuel flow of the second region.

2. A nozzle as claimed in claim 1, wherein the nozzle holder and tip are shaped to include features arranged to cooperate with one another when the tip and nozzle holder occupy a predetermined relative axial position.

3. A nozzle as claimed in claim 1, wherein the nozzle holder and tip carry a sealing gasket.

* * * * *